US005226605A

United States Patent [19]

Bazergui et al.

[11] Patent Number: 5,226,605

[45] Date of Patent: Jul. 13, 1993

[54] ROTARY ATOMIZER DISK WITH REPLACEABLE NOZZLE INSERTS AND METHOD FOR REPLACING INSERTS

[75] Inventors: Claude Bazergui, Lac Guindon; David Berry, Boisbriand, both of Canada

[73] Assignee: Barr & Murphy (Canada) LTEE/Ltd., Quebec, Canada

[21] Appl. No.: 953,236

[22] Filed: Sep. 30, 1992

[51] Int. Cl.[5] ..... B05B 3/10

[52] U.S. Cl. ..... 239/1; 239/222.11; 239/223

[58] Field of Search ..... 239/1, 214, 222.11, 239/223, 224, 225.1, 390, 600

[56] References Cited

U.S. PATENT DOCUMENTS

| | | | |
|---|---|---|---|
| Re. 30,963 | 6/1982 | Moller et al. | 239/224 |
| Re. 32,064 | 1/1986 | Nielsen | 239/224 |
| 2,584,973 | 2/1952 | Andermatt . | |
| 3,392,917 | 7/1968 | Trommelen . | |
| 3,677,471 | 7/1972 | Deakin . | |
| 3,711,025 | 1/1973 | Miller | 239/222.11 |
| 3,887,133 | 6/1975 | Straarup et al. | 239/224 |
| 3,986,670 | 10/1976 | Syveson . | |
| 4,082,221 | 4/1978 | Brummelhuis . | |
| 4,214,708 | 7/1980 | Lacchia . | |
| 4,260,873 | 4/1981 | Simmonds . | |
| 4,303,200 | 12/1981 | Hansen | 239/223 |
| 4,370,944 | 1/1983 | Nagata et al. . | |
| 4,760,965 | 8/1988 | Schneider . | |
| 4,828,178 | 5/1989 | Tucker et al. | 239/390 |

FOREIGN PATENT DOCUMENTS

| | | | |
|---|---|---|---|
| 1041878 | 5/1952 | Fed. Rep. of Germany | 239/224 |
| 2282298 | 3/1976 | France | 239/600 |
| 507365 | 4/1976 | U.S.S.R. | 239/223 |
| 2117275 | 10/1953 | United Kingdom | 239/600 |

*Primary Examiner*—Andres Kashnikow
*Assistant Examiner*—Karen B. Merritt
*Attorney, Agent, or Firm*—Marks & Murase

[57] ABSTRACT

The rotary atomizer disk has an upper part and a lower part connectable to the upper part using a plurality of screws. The disk comprises a number of atomizer nozzle insert receiving holes for receiving a corresponding number of nozzle inserts from outside the disk, and a number of screw receiving bores passing at least partially through each of the insert receiving holes for receiving the screws connecting the lower part to the upper part. In this way, by removing any one of the screws, a corresponding one of the nozzle inserts can be removed from the disk without disassembling it. The inserts may be symmetrical and be turned or reversed to be reused. The invention avoids the need to rebalance the disk after disassembling for nozzle replacement purposes.

10 Claims, 1 Drawing Sheet

ROTARY ATOMIZER DISK WITH REPLACEABLE NOZZLE INSERTS AND METHOD FOR REPLACING INSERTS

FIELD OF THE INVENTION

The present invention relates to a rotary atomizer disk having replaceable inserts. The invention relates further to an atomizer disk and a method in which the inserts are replaced without disassembling the disk. The invention also relates to the replaceable inserts for use with the atomizer disk.

BACKGROUND OF THE INVENTION

Rotary atomizer disks are used in commercial spray drying or congealing units. The disks are provided with a large number of nozzle inserts through which the liquid to be dried or congealed is atomized or sprayed. The disk is rotated at a very high speed, normally between 10,000 to 20,000 rpm. The fluid flow through the nozzle inserts wears down the trailing edge of the orifice of the inserts, and therefore the inserts must be replaced in order to avoid improper fluid flow and distribution.

The conventional way to replace nozzle inserts has been to disassemble the entire disk unit, which is usually formed of two parts, namely upper and lower. The inserts are conventionally seated against an inside edge of insert receiving holes, and can be pushed in and removed.

The conventional way is time consuming and can even lead to serious problems if the reassembled disk is improperly reassembled such that an imbalance occurs.

SUMMARY OF THE INVENTION

Accordingly, it is an object of the present invention to provide an atomizer disk with replaceable nozzle inserts which can be replaced without disassembling the atomizer disk. It is another object of the present invention to provide disk inserts which can be reused, and can be individually replaced.

According to the invention, there is provided a rotary atomizer disk having an upper part and a lower part connectable to the upper part using a plurality of screws, comprising a number of atomizer nozzle insert receiving means for receiving a corresponding number of nozzle inserts from outside the disk, and a number of screw receiving bores passing at least partially through each insert receiving means for receiving the screws connecting the lower part to the upper part. In this way, by removing any one of the screws, a corresponding one of the nozzle inserts can be removed from the disk without disassembling the disk.

The invention also provides an atomizer disk nozzle insert for use with a rotary atomizer disk having an upper part and a lower part connectable to the upper part using a plurality of screws, the disk comprising a number of atomizer nozzle insert receiving means each receiving nozzle inserts from outside the disk, and a number of screw receiving bores passing at least partially through each insert receiving means for receiving the screws connecting the lower part to the upper part, comprising a fluid conducting bore passing through the insert for conducting fluid to be atomized from within the disk to outside the disk, and a screw receiving notch for at least partially receiving one of the screws. Accordingly, by removing any one of the screws, a corresponding one of the nozzle inserts can be removed from the disk without disassembling the disk.

The invention further provides a method for replacing a used disk insert of a rotary atomizer disk having an upper part and a lower part connectable to the upper part using a plurality of screws, the disk comprising a number of atomizer nozzle insert receiving means each receiving nozzle inserts from outside the disk, and a number of screw receiving bores passing at least partially through each insert receiving means for receiving the screws connecting the lower part to the upper part, the insert comprising a fluid conducting bore passing through the insert for conducting fluid to be atomized from within the disk to outside the disk, and a screw receiving notch for at least partially receiving one of the screws. The method comprises the steps of inserting an insert pulling tool through the fluid conducting bore of the used disk insert, unscrewing one of the screws corresponding to the used disk insert, engaging the tool against an inner face of the used insert, pulling out the used disk insert from the corresponding insert receiving means, and inserting an unused disk insert into the corresponding insert receiving means.

Preferably, the receiving means are cylindrically shaped for receiving cylindrically shaped nozzle inserts, the screw bores passing through one side of the receiving means such that the screws may be inserted into notches in a side of the inserts.

BRIEF DESCRIPTION OF THE DRAWINGS

The invention will be better understood by way of the following detailed description of a preferred embodiment of the invention with reference to the appended drawing in which.

DETAILED DESCRIPTION OF THE PREFERRED EMBODIMENT

Figure 1:
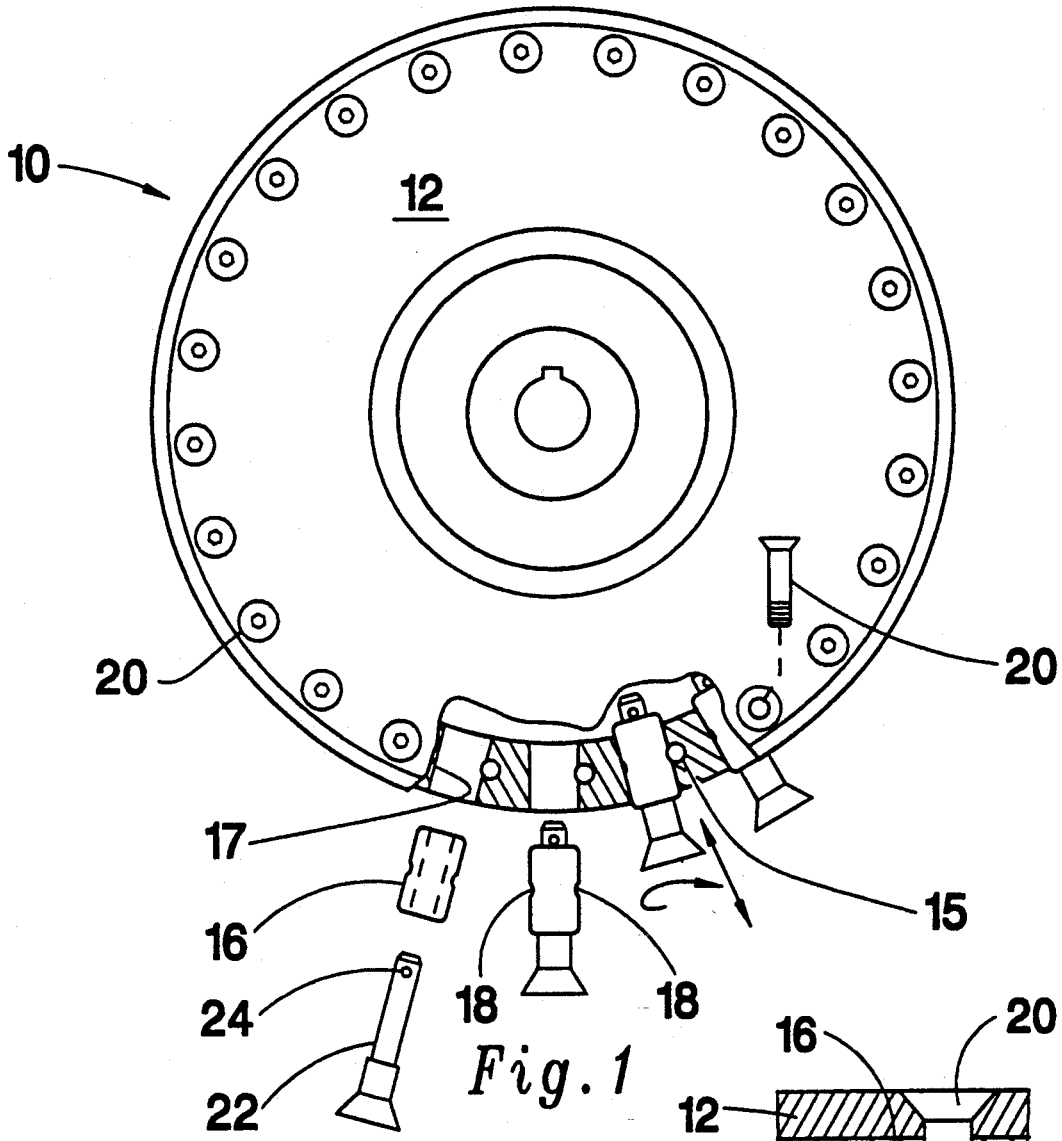
FIG. 1 is a plan view of the disk according to the preferred embodiment.
Figure 2:
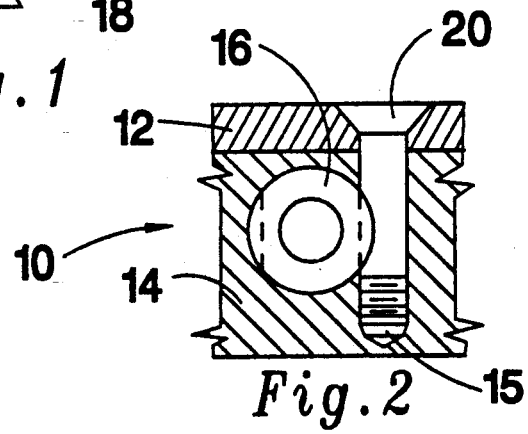
FIG. 2 is a partial sectional view of the disk of FIG. 1 taken tangentially through one of the inserts.
Figure 3:
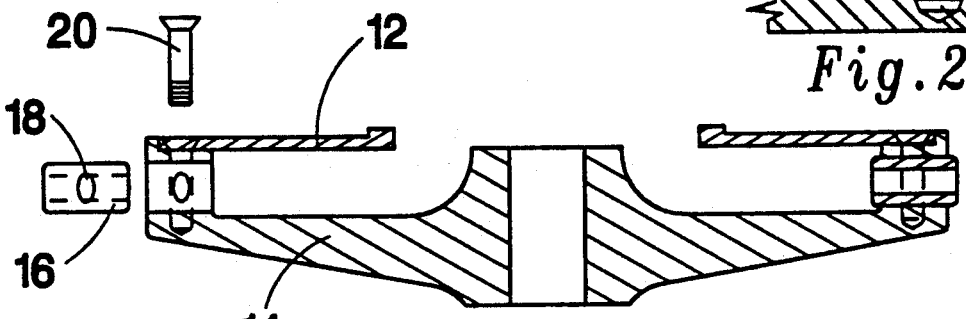
FIG. 3 is sectional view of the disk of FIG. 1 taken about a plane passing though the disk axis.

In FIG. 1 there is shown a rotary atomizer disk (10) provided with 24 metal screws for fastening plate (12) to lower part and hub (14), as shown in FIG. 3. Screws (20) are fit into threaded bores (15) which pass through nozzle insert receiving holes (17) into which the nozzle inserts (16) are fit as shown in FIGS. 1 and 2. About one quarter of the diameter of screw (20) penetrates into one of the side notches (18) of insert (16).

As shown in FIG. 1, insert (16) can be removed from its receiving hole (17) by inserting a tool (22) through the nozzle opening of insert (16). A spring loaded ball bearing (24) pops up on the inside of disk (10) and will bear against an inside face of insert (16) for creating a pulling force on insert (16). Screw (20) is then removed from screw bore (15) which frees the insert (16) to be removed from hole (17). Using tool (22), the insert (16) is pulled out of hole (17) for replacement.

Replacement can involve flipping or rotating insert (16) such that the used edge of the fluid passageway orifice passing through insert (16) is replaced by an edge of the tubular passageway which is unused. Inserts (16) are made of a ceramic material and due to the high fluid velocities and forces bearing against the downstream side on the outside orifice tip of the fluid conducting bore passing through the inserts (16), a wearing down of the insert material occurs at that downstream side. Such wearing down can affect the atomization properties of the nozzle inserts (16), and by rotating or flipping the inserts (16) to place an unused edge in place of the used edge, quality atomization is ensured. It is of course possible to use each nozzle insert (16) four times before requiring disposal of the nozzle insert (16).

If the nozzle inserts (16) are designed to be of a non-symmetrical shape, it would not be possible to rotate or flip them to provide an unused edge at the downstream side of the fluid conducting bore, and therefore simple replacement of the inserts (16) would be necessary. It is also noted that it is possible to place the heads of screws (20) on the underside of disk (10) such that without even removing disk (10) from its drive shaft, it is possible to replace or renew a worn disk insert (16).

What is claimed is:

1. A rotary atomizer disk having an upper part and a lower part connectable to said upper part using a plurality of screws, said disk comprising:

a number of atomizer nozzle insert receiving means for receiving a corresponding number of nozzle inserts from outside said disk; and a number of screw receiving bores passing at least partially through each said insert receiving means for receiving said screws connecting said lower part to said upper part, whereby by removing any one of said screws, a corresponding one of said nozzle inserts can be removed from said disk without disassembling said disk.

2. The atomizer disk as claimed in claim 1, wherein said receiving means are cylindrically shaped for receiving cylindrically shaped nozzle inserts, said bores passing through one side of said receiving means such that said screws may be inserted into notches in a side of said inserts.

3. An atomizer disk nozzle insert for use with a rotary atomizer disk having an upper part and a lower part connectable to said upper part using a plurality of screws, said disk comprising a number of atomizer nozzle insert receiving means each receiving nozzle inserts from outside said disk, and a number of screw receiving bores passing at least partially through each said insert receiving means for receiving said screws connecting said lower part to said upper part, said insert comprising:

a fluid conducting bore passing through said insert for conducting fluid to be atomized from within said disk to outside said disk; and a screw receiving notch for at least partially receiving one of said screws, whereby by removing any one of said screws, a corresponding one of said nozzle inserts can be removed from said disk without disassembling said disk.

4. Insert as claimed in claim 3, wherein said insert is cylindrically shaped, whereby said insert may be removed, flipped and used once again.

5. Insert as claimed in claim 4, further comprising another screw receiving notch opposite said one screw receiving notch, whereby said insert may be rotated and used once again.

6. Insert as claimed in claim 5, wherein said insert is made of ceramic material.

7. Insert as claimed in claim 4, wherein said insert is made of ceramic material.

8. Insert as claimed in claim 3, wherein said insert is made of ceramic material.

9. A method for replacing a used disk insert of a rotary atomizer disk having an upper part and a lower part connectable to said upper part using a plurality of screws, said disk comprising a number of atomizer nozzle insert receiving means each receiving nozzle inserts from outside said disk, and a number of screw receiving bores passing at least partially through each said insert receiving means for receiving said screws connecting said lower part to said upper part, said insert comprising a fluid conducting bore passing through said insert for conducting fluid to be atomized from within said disk to outside said disk, and a screw receiving notch for at least partially receiving one of said screws, the method comprising the steps of:

inserting an insert pulling tool through said fluid conducting bore of said used disk insert;

unscrewing one of said screws corresponding to said used disk insert;

engaging said tool against an inner face of said used insert;

pulling out said used disk insert from said corresponding insert receiving means; and inserting an unused disk insert into said corresponding insert receiving means.

10. Method as claimed in claim 9, wherein said nozzle inserts and said fluid conducting bores are cylindrically shaped, and said unused disk insert is said used insert repositioned such that an unused edge of said fluid conducting bore replaces a used edge of said fluid conducting bore.

* * * * *